US011735199B2

(12) United States Patent
Duong et al.

(10) Patent No.: US 11,735,199 B2
(45) Date of Patent: Aug. 22, 2023

(54) METHOD FOR MODIFYING A STYLE OF AN AUDIO OBJECT, AND CORRESPONDING ELECTRONIC DEVICE, COMPUTER READABLE PROGRAM PRODUCTS AND COMPUTER READABLE STORAGE MEDIUM

(71) Applicant: INTERDIGITAL MADISON PATENT HOLDINGS, SAS, Paris (FR)

(72) Inventors: Quang Khanh Ngoc Duong, Cesson-Sevigne (FR); Alexey Ozerov, Cesson-Sevigne (FR); Eric Grinstein, Rio de Janeiro (BR); Patrick Perez, Rennes (FR)

(73) Assignee: INTERDIGITAL MADISON PATENT HOLDINGS, SAS, Paris (FR)

( * ) Notice: Subject to any disclaimer, the term of this patent is extended or adjusted under 35 U.S.C. 154(b) by 0 days.

(21) Appl. No.: 16/648,217

(22) PCT Filed: Sep. 14, 2018

(86) PCT No.: PCT/EP2018/074875
§ 371 (c)(1),
(2) Date: Mar. 17, 2020

(87) PCT Pub. No.: WO2019/053188
PCT Pub. Date: Mar. 21, 2019

(65) Prior Publication Data

US 2020/0286499 A1 Sep. 10, 2020

(30) Foreign Application Priority Data

Sep. 18, 2017 (EP) ..... 17306202

(51) Int. Cl.
*G10L 13/00* (2006.01)
*G10L 13/06* (2013.01)
(Continued)

(52) U.S. Cl.
CPC ..... *G10L 21/003* (2013.01); *G10L 21/013* (2013.01)

(58) Field of Classification Search
CPC ..... G10L 2021/0135; G10L 21/003; G10L 13/0335; G10L 25/81; G10L 21/007;
(Continued)

(56) References Cited

U.S. PATENT DOCUMENTS 9,947,341 B1 * 4/2018 Marsh ..... G10L 25/18
2007/0168189 A1 * 7/2007 Tamura ..... G10L 13/033 704/235

(Continued)

FOREIGN PATENT DOCUMENTS

CN 101004910 A 7/2007
CN 104272382 A1 1/2015

(Continued)

OTHER PUBLICATIONS

Perez et al. "Style Transfer for Prosodic Speech", Stanford University, Technical Report, 2017, 6 pages.

(Continued)

*Primary Examiner* — Michael Ortiz-Sanchez
(74) *Attorney, Agent, or Firm* — Volpe Koenig

(57) ABSTRACT

Method for modifying a style of an audio object, and corresponding electronic device, computer readable program products and computer readable storage medium The disclosure relates to a method for processing an input audio signal. According to an embodiment, the method includes obtaining a base audio signal being a copy of the input audio signal and generating an output audio signal from the base (Continued)

signal, the output audio signal having style features obtained by modifying the base signal so that a distance between base style features representative of a style of the base signal and a reference style feature decreases. The disclosure also relates to corresponding electronic device, computer readable program product and computer readable storage medium.

16 Claims, 5 Drawing Sheets

(51) Int. Cl.
*G10L 21/003* (2013.01)
*G10L 21/013* (2013.01)

(58) Field of Classification Search
CPC ..... G10L 21/013; G10L 25/45; G10L 25/51; G10L 21/00; G10L 13/033; H04S 2400/01; G06F 3/16; G06F 3/162; G06F 3/167; G06F 3/165; G06F 5/00; G06F 5/06; G06F 5/01; G06F 16/583; G06F 16/7834; G06F 2221/0724; H04H 60/58; G10G 1/04; G10G 3/04
See application file for complete search history.

(56) References Cited

U.S. PATENT DOCUMENTS

| | | | | |
|---|---|---|---|---|
| 2007/0289432 | A1* | 12/2007 | Basu | G10H 7/008 84/609 |
| 2013/0019738 | A1* | 1/2013 | Haupt | G10L 21/013 84/622 |
| 2016/0104474 | A1* | 4/2016 | Bunn | G10L 21/003 704/261 |
| 2017/0345433 | A1* | 11/2017 | Dittmar | G10L 13/04 |
| 2018/0033449 | A1* | 2/2018 | Theverapperuma | G10L 25/84 |

FOREIGN PATENT DOCUMENTS

| | | | |
|---|---|---|---|
| EP | 1087370 | A1 | 3/2001 |
| WO | 2013133768 | A | 9/2013 |
| WO | WO 2015184615 | A1 | 12/2015 |

OTHER PUBLICATIONS

Hadjeres et al., "DeepBach: a Steerable Model for Bach Chorales Generation", International Conference on Machine Learning, Sydney, Australia, Aug. 6, 2017, pp. 1362-1371.
Nakano et al., "Vocalistener: A Singing-To-Singing Synthesis System Based on Iterative Parameter Estimation", Proceedings of the SMC 2009—6th Sound and Music Computing Conference, Porto, Portugal, Jul. 23, 2009, pp. 343-348.
McDermott et al., "Sound Texture Perception via Statistics of the Auditory Periphery: Evidence from Sound Synthesis", Neuron, vol. 71, No. 5, Sep. 8, 2011, pp. 926-940.
Bonada et al., "Generation of Growl-Type Voice Qualities by Spectral Morphing", 2013 IEEE International Conference on Acoustics, Speech and Signal Processing (ICASSP), Vancouver, British Columbia, Canada, May 26, 2013, pp. 6910-6914.
Tian et al., "An Exemplar-Based Approach to Frequency Warping for Voice Conversion", IEEE/ACM Transactions on Audio, Speech, and Language Processing, vol. 25, No. 10, Oct. 2017, pp. 1863-1876.
Aytar et al., "Soundnet: Learning Sound Representations from Unlabeled Video", 30th Conference on Neural Information Processing Systems (NIPS 2016), Barcelona, Spain, Dec. 5, 2016, 9 pages.
Pacheti, F., "A Joyful Ode to Automatic Orchestration", ACM Transactions on Intelligent Systems and Technology, vol. 8, No. 2, Article 18, Oct. 2016, 13 pages.
Villavicencio et al., "Observation-Model Error Compensation for Enhanced Spectral Envelope Transformation in Voice Conversation", 2015 IEEE International Workshop on Machine Learning for Signal Processing, Boston, Massachusetts, USA, Sep. 17, 2015, 6 pages.
Gatys et al., "A Neural Algorithm of Artistic Style", Cornell University, Computer Science, Technical Paper arXiv:1508.06576, Sep. 2, 2015, 16 pages.
Engel et al., "Neural Audio Synthesis of Musical Notes with WaveNet Autoencoders", Proceedings of the 34th International Conference on Machine Learning, vol. 70, Apr. 7, 2017, pp. 1068-1077.
Zhu et al., "Unpaired Image-to-Image Translation using Cycle-Consistent Adversarial Networks", IEEE International Conference on Computer Vision (ICCV), Venice, Italy, Oct. 22, 2017, pp. 2223-2232.
Zhou et al., "Combining Information from Multi-Stream Features Using Deep Neural Network in Speech Recognition", 2012 IEEE 11th International Conference on Signal Processing (ICSP 2012), Beijing, China, Oct. 21, 2012, pp. 557-561.
Van Den Oord et al., "Wavenet: A Generative Model for Raw Audio", 9th ISCA Speech Synthesis Workshop, Sunnyvale, California, USA, Sep. 13, 2016, 15 pages.
Amatriain et al., "Spectral Modeling for Higher-level Sound Transformations", MOSART Workshop on Current Research Directions in Computer Music, Barcelona, Spain, Nov. 15, 2001, 9 pages.
Foote et al., "Do Androids Dream of Electric Beats", Audio Style Transfer, http://audiostyletransfer.wordpress.com/2016/12/14/do-androids-dream-of-electric-beats/, Dec. 14, 2016, 18 pages.
Grinstein et al., "Audio Style Transfer", 2018 IEEE International Conference on Acoustics, Speech and Signal Processing (ICASSP), Calgary, Alberta, Canada, Apr. 15, 2018, 5 pages.
Isola et al., "Image-to-Image Translation with Conditional Adversarial Networks", 2017 IEEE Conference on Computer Vision and Pattern Recognition (CVPR), Honolulu, Hawaii, USA, Jul. 21, 2017, pp. 1125-1134.
Hoffman et al., "Feature-Based Synthesis: Mapping Acoustic and Perceptual Features onto Synthesis Parameters", New Orleans, Loiusiana, USA, Nov. 6, 2006, 4 pages.
Ulyanov et al., "Audio texture synthesis and style transfer", http://dmitryulyanov.github.io/audio-texture-synthesis-and-style-transfer/, Dec. 13, 2016, 4 pages.
Kazazis et al., "Sound Morphing by Audio Descriptors and Parameter Interpolation" Proceedings of the 19th International Conference on Digital Audio Effects (DAFx-16), Brno, Czech Republic, Sep. 5, 2016, 7 pages.
Kawahara et al., "Auditory Morphing Based on an Elastic Perceptual Distance Metric in an Interference-Free Time-Frequency Representation", 2003 IEEE International Conference on Acoustics, Speech, and Signal Processing (ICASSP '03), Hong Kong, China, Apr. 6, 2003, pp. 256-259.

* cited by examiner

METHOD FOR MODIFYING A STYLE OF AN AUDIO OBJECT, AND CORRESPONDING ELECTRONIC DEVICE, COMPUTER READABLE PROGRAM PRODUCTS AND COMPUTER READABLE STORAGE MEDIUM

This application claims the benefit, under 35 U.S.C. § 371 of International Application PCT/EP2018/074875, filed Sep. 14, 2018, which was published in accordance with PCT Article 21(2) on Mar. 21, 2019, in English, and which claims the benefit of European Patent Application No. 17306202.7, filed Sep. 18, 2017.

1. TECHNICAL FIELD

The present disclosure relates to the technical domain of style transfer.

A method for modifying a style of an audio object, and corresponding electronic device, computer readable program products and computer readable storage medium are described.

2. BACKGROUND ART

The "style" of an object can be defined herein as a distinctive manner which permits the grouping of the object into a related category. or any distinctive, and therefore recognizable, way in which an act is performed or an artifact made. It can refer for instance in the artistic domain to a way of painting, of singing, a musical genre, or more generally of creating, attributable to a given artist, a given cultural group or to an artistic trend. A style can be characterized by distinctive characteristics that make the style identifiable. For instance, in painting, a characteristic can be a blue color such as Klein or brush strokes such as Van Gogh.

Style transfer is the task of transforming an object in such a way that its style resembles the style of a given example.

This class of computational methods are of special interest in film post-production for instance, where one could generate different renditions of the same scene under different "style parameters". It is notably becoming of increasing use for general public in the technical field of image processing. For instance, some solutions can permit to transform a photograph in a way that conserve the content of the original photograph while giving it a touch, or style, attributable to a famous painter. The resulting image can for instance keep faces of characters present in the original photograph while incorporating brush strokes as in some Van Gogh paintings.

Some prior art solutions have tried to extent existing solutions adapted to images to the technical field of audio processing. However, using those existing solutions does not lead to satisfying results.

It is of interest to propose efficient techniques for proposing transfer style technics, adapted to other technical fields than image processing.

3. SUMMARY

The present principles propose a method for processing at least one input audio signal.

According to at least one embodiment of the present disclosure, said method comprises:

obtaining at least one base audio signal being a copy of said at least one input audio signal;

generating at least one output audio signal from said at least one base audio signal, said at least one output audio signal having style features obtained by modifying said at least one base signal so that a distance between at least one base style feature representative of a style of said at least one base signal and at least one reference style feature decreases.

According to another aspect, the present disclosure relates to an electronic device comprising at least one memory and one or several processors configured for collectively processing at least one input audio signal.

According to at least one embodiment of the present disclosure, said processing comprises:

obtaining at least one base audio signal being a copy of said at least one input audio signal;

generating at least one output audio signal from said at least one base signal, said at least one output audio signal having style features obtained by modifying said at least one base signal so that a distance between at least one base style feature representative of a style of said at least one base signal and at least one reference style feature decreases.

According to another aspect, the present disclosure relates to a non-transitory computer readable program product comprising program code instructions for performing the method of the present disclosure, in any of its embodiments, when said software program is executed by a computer.

According to at least one embodiment of the present disclosure, said non-transitory computer readable program product comprises program code instructions for performing, when said non-transitory software program is executed by a computer, a method for processing at least one input audio signal, said method comprising:

obtaining at least one base audio signal being a copy of said at least one input audio signal;

generating at least one output audio signal from said at least one base signal, said at least one output audio signal having style features obtained by modifying said at least one base signal so that a distance between at least one base style feature representative of a style of said at least one base signal and at least one reference style feature decreases.

According to another aspect, the present disclosure relates to a non-transitory program storage device, readable by a computer.

According to at least one embodiment of the present disclosure, the present disclosure relates to a non-transitory program storage device carrying a software program comprising program code instructions for performing the method of the present disclosure, in any of its embodiments, when said software program is executed by a computer.

According to at least one embodiment of the present disclosure, said software program comprises program code instructions for performing, when said non-transitory software program is executed by a computer, a method for processing at least one input audio signal, said method comprising:

obtaining at least one base audio signal being a copy of said at least one input audio signal;

generating at least one output audio signal from said at least one base signal, said at least one output audio signal having style features obtained by modifying said at least one base signal so that a distance between at least one base style feature representative of a style of said at least one base signal and at least one reference style feature decreases.

According to another aspect, the present disclosure relates to a computer readable storage medium carrying a software program.

According to at least one embodiment of the present disclosure, said software program comprises program code instructions for performing the method of the present disclosure, in any of its embodiments, when said software program is executed by a computer.

According to at least one embodiment of the present disclosure, said software program comprises program code instructions for performing, when said non-transitory software program is executed by a computer, a method for processing at least one input audio signal, said method comprising:

obtaining at least one base audio signal being a copy of said at least one input audio signal;

generating at least one output audio signal from said at least one base signal, said at least one output audio signal having style features obtained by modifying said at least one base signal so that a distance between at least one base style feature representative of a style of said at least one base signal and at least one reference style feature decreases.

4. LIST OF DRAWINGS

The present disclosure will be better understood, and other specific features and advantages will emerge upon reading the following description, the description making reference to the annexed drawings wherein.

It is to be noted that the drawings have only an illustration purpose and that the embodiments of the present disclosure are not limited to the illustrated embodiments.

5. DETAILED DESCRIPTION OF THE EMBODIMENTS

At least some principles of the present disclosure relate to modify a style of an input audio object.

An audio object can be for instance an audio and/or audiovisual stream or content, like an audio recording and/or an audio and video recording of one or several sound producing source(s).

The at least one sound producing source can be of diverse type. For instance, an audio object can comprise an audio recording including a human voice, a sound produced by a human activity (like a use of a tool (e.g. a hammer), an animal sound, a sound produced by nature elements (like waves, rain, storm, waterfall, wind, rock drops, . . . ).

Notably the audio component of an audio object can be a mixture of several sound producing sources.

In a purpose of simplicity, the present disclosure is detailed herein after in link with audio components of audio objects (being either of audio and/or audiovisual type). An audio component is also called hereinafter "audio signal", or more simply "sound".

Figure 1:
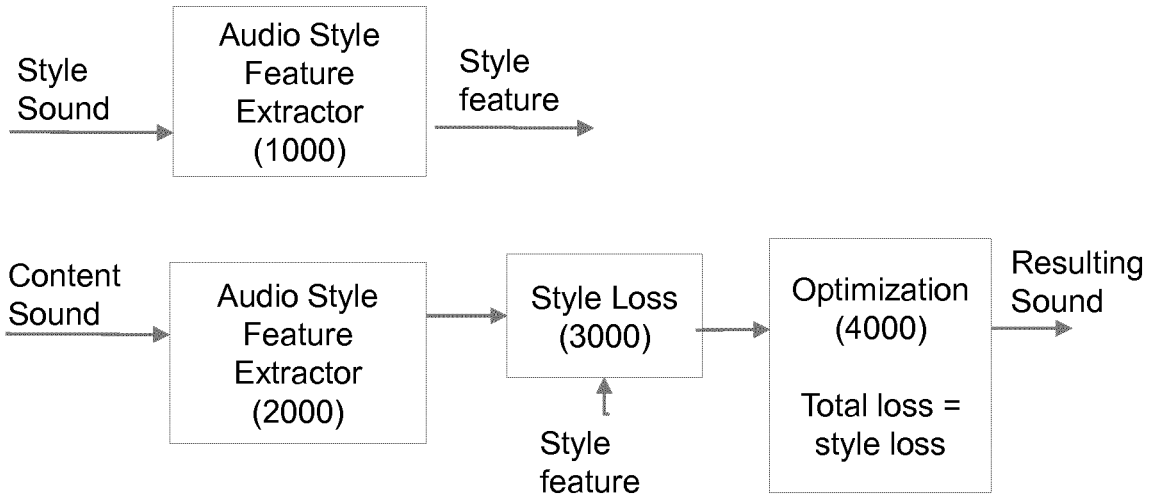
FIG. 1 illustrates a simplified workflow of an exemplary audio style transfer system.

FIG. 1 illustrates a simplified workflow of an exemplary audio style transfer system according to at least one embodiment of the present disclosure.

In at least one embodiment, the present disclosure aims generating at least an output audio signal, or "output sound" based on at least one other audio signal, or "input sound". In at least one embodiment, the generating can also take into account a reference audio signal. Optionally, the generating can also include obtaining at least one additional element, like an audio and/or visual component or metadata, to be included in the output audio object. Depending upon embodiments, such an additional element can be obtained from the input audio object or from the audio object which style is to be used, or from another source. An additional component or metadata can for instance be timely synchronized with the output audio sound.

More specifically, in at least some embodiments of the present disclosure, characteristics related to the structure of a first "input" sound, therefore called "content sound", are (at least partially) preserved in the output sound. Characteristics related to the texture of a second "reference" sound, henceforth named "style sound" should be equally kept (at least partially).

Texture notably encompasses herein, for an audio signal, repeating patterns in small temporal scales that play the main role in what is called "style" here.

Structures notably refer to longer temporal elements that make the audio signal that capture most of the high-level meaning, that is the "content".

As an example, in some embodiments where the content sound and the style sound are both speeches, characteristics to be preserved in the content sound can comprise words of the speech (the meaning of the speech), pitch and/or loundness while characteristics to be transferred from the style content can be related to the accent of the style sound like timber, tempo, and rhythm.

It is to be noted some characteristics of an audio signal can be considered, depending to the embodiments, either as "content" feature or as "style" feature. This can be the case for instance, in some other embodiments where both content sound and the style sound are speeches, for characteristics like pitch and/or loundness.

in some embodiments, a transfer of a style of the style sound can be performed for instance, as in some of the illustrated embodiments detailed hereinafter, by extracting meaningful characteristics (i.e. features) from the "style" sound and progressively incorporating them in a sound signal derived from the "content" sound.

Another embodiment can involve extracting meaningful characteristics (i.e. features) from each of the content and style sounds, and generating, through an optimization procedure for instance, an output sound which features correspond (either exactly or closely) to the meaningful characteristics extracted from both content and style sounds.

Some embodiments of the present disclosure can be applied in the technical field of audio manupulation and editing, both for consumer applications and professional sound design.

An exemplary use case of the present disclosure, in the technical field of professional content editing (for instance in the dubbing and translation industry), can include converting a human voice's accent or pitch into a different one. Such use case can also be of interest for consumers apps built in e.g. smartphones or TV. Another use case, in the technical field of movie production, can include converting a human voice to an output sound being still sort of human voice (for instance with understandable speech), but with a style obtained from a recording of barking. According to still another use case, a content speech can be converted to an output speech that can be heart as if it is was spoken by a person (that spokes in the style sound) other than the one that has spoken the content speech.

Still another exemplary use case can relate to the technical field of music manipulation. For instance, an output sound (or styled sound) can be generated from a sound of a first musical instrument (used as a content sound) and a sound of a second, different, musical instrument (used as a style sound) by keeping, in the output sound, the notes being played in the first, "content", sound but as if they were played by the second instrument. Such a solution can help making music production easier and extremely interesting.

At least some embodiments of the present disclosure can also be used in consumer application related to online image services (including social networking and messaging).

Figure 6:
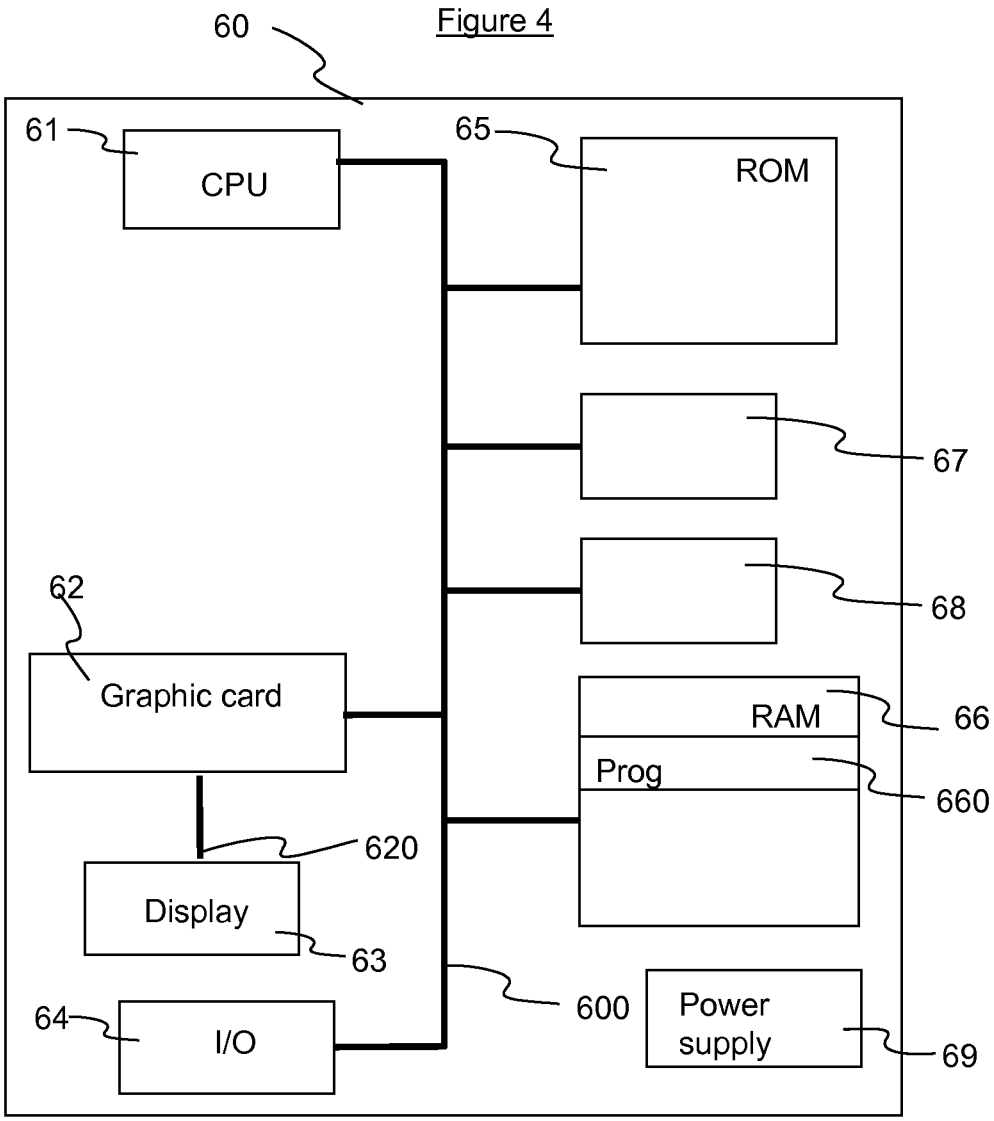
FIG. 6 illustrates an electronic device according to at least one exemplary embodiment of the present disclosure.

FIG. 6 describes the structure of an electronic device 60 that can be configured notably to perform one or several of the embodiments of the method of the present disclosure.

The electronic device can be any audio acquiring device or an audio and video content acquiring device, like a smart phone or a microphone. It can also be a device without any audio and/or video acquiring capabilities but with audio processing capabilities and/or audio and video processing capabilities. In some embodiment, the electronic device can comprise a communication interface, like a receiving interface adapted to receive an audio and/or an video stream and notably a reference (or style) audio object or an input audio object to be processed according to the method of the present disclosure. This communication interface is optional. Indeed, in some embodiments, the electronic device can process audio objects stored in a medium readable by the electronic device, previously received or acquired by the electronic device.

In the exemplary embodiment of FIG. 6, the electronic device 60 can include different devices, linked together via a data and address bus 600, which can also carry a timer signal. For instance, it can include a micro-processor 61 (or CPU), a graphics card 62 (depending on embodiments, such a card may be optional), a ROM (or «Read Only Memory») 65, a RAM (or «Random Access Memory») 66, at least one Input/Output audio module 64 (like a microphone, a loudspeaker, and so on). The electronic device can also include at least one other Input/Output module (like a keyboard, a mouse, a led, and so on), In the exemplary embodiment of FIG. 6, the electronic device can also comprise at least one communication interface 67 configured for the reception and/or transmission of data, notably audio and/or video data, via a wireless connection (notably of type WIFI® or Bluetooth®), at least one wired communication interface 68, a power supply 69. Those communication interfaces are optional.

In some embodiments, the electronic device 60 can also include, or be connected to, a display module 63, for instance a screen, directly connected to the graphics card 62 by a dedicated bus 620.

The Input/Output audio module 64, and optionally the display module, can be used for instance in order to output information, as described in link with the rendering steps of the method of the present disclosure described hereinafter.

In the illustrated embodiment, the electronic device 60 can communicate with a server (for instance a provider of a bank of reference audio samples or audio and video samples) thanks to a wireless interface 67.

Each of the mentioned memories can include at least one register, that is to say a memory zone of low capacity (a few binary data) or high capacity (with a capability of storage of an entire audio and/or video file notably).

When the electronic device 60 is powered on, the microprocessor 61 loads the program instructions 660 in a register of the RAM 66, notably the program instruction needed for performing at least one embodiment of the method described herein, and executes the program instructions.

According to a variant, the electronic device 60 includes several microprocessors.

According to another variant, the power supply 69 is external to the electronic device 60.

In the exemplary embodiment illustrated in FIG. 6, the microprocessor 61 can be configured for processing at least one input audio signal, said processing comprising:

generating at least one output audio signal from the at least one input audio signal by optimizing at least one base signal by taking account of at least one reference style feature.

According to at least one embodiment of the present disclosure, said processing comprises:

obtaining a base audio signal being a copy of said at least one input audio signal;

generating at least one output audio signal from said at least one base signal, said output audio signal having style features obtained by modifying said base signal so that a distance between base style features representative of a style of said at least one base signal and at least one reference style feature decreases.

At least an embodiment of the method of the present disclosure relates to an example-based style-transfer. The goal is to transfer some "style" characteristic (or reference style feature), being for instance representative of at least one audio signal (also referred to herein as style sound) to another audio signal (referred to herein as content sound) so as to create a resulting audio signal (referred to herein as styled, resulting or output sound).

Figure 2:
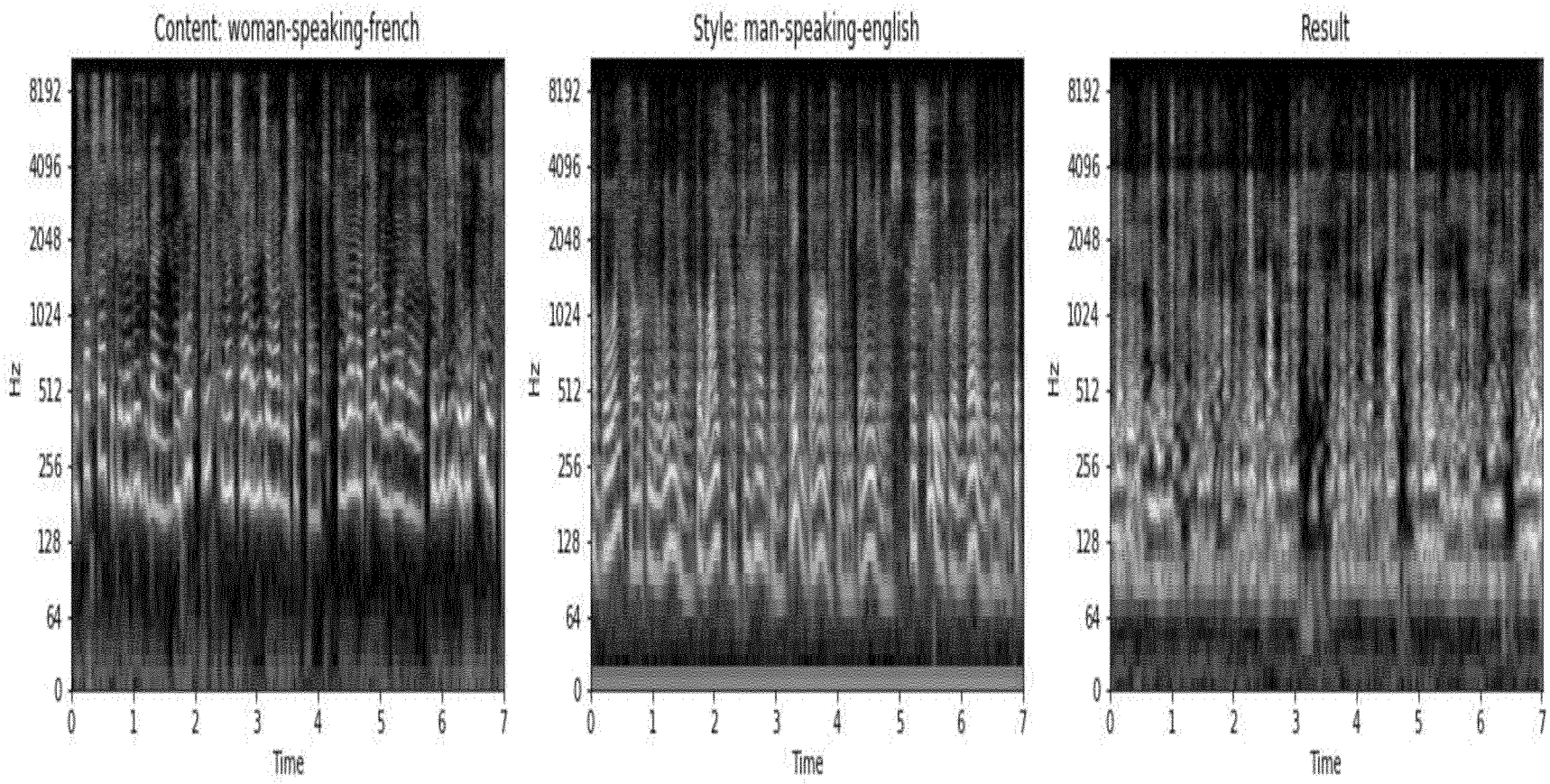
FIG. 2 shows an example of the spectrograms of a content sound, a style sound, and a resulting sound.

FIG. 2 shows an example of the spectrograms of a content sound (left), a style sound (middle), and a resulting sound (right) that can obtained from the content sound and the style sound, thanks to some embodiment of the method of the present disclosure.

Figure 5A:
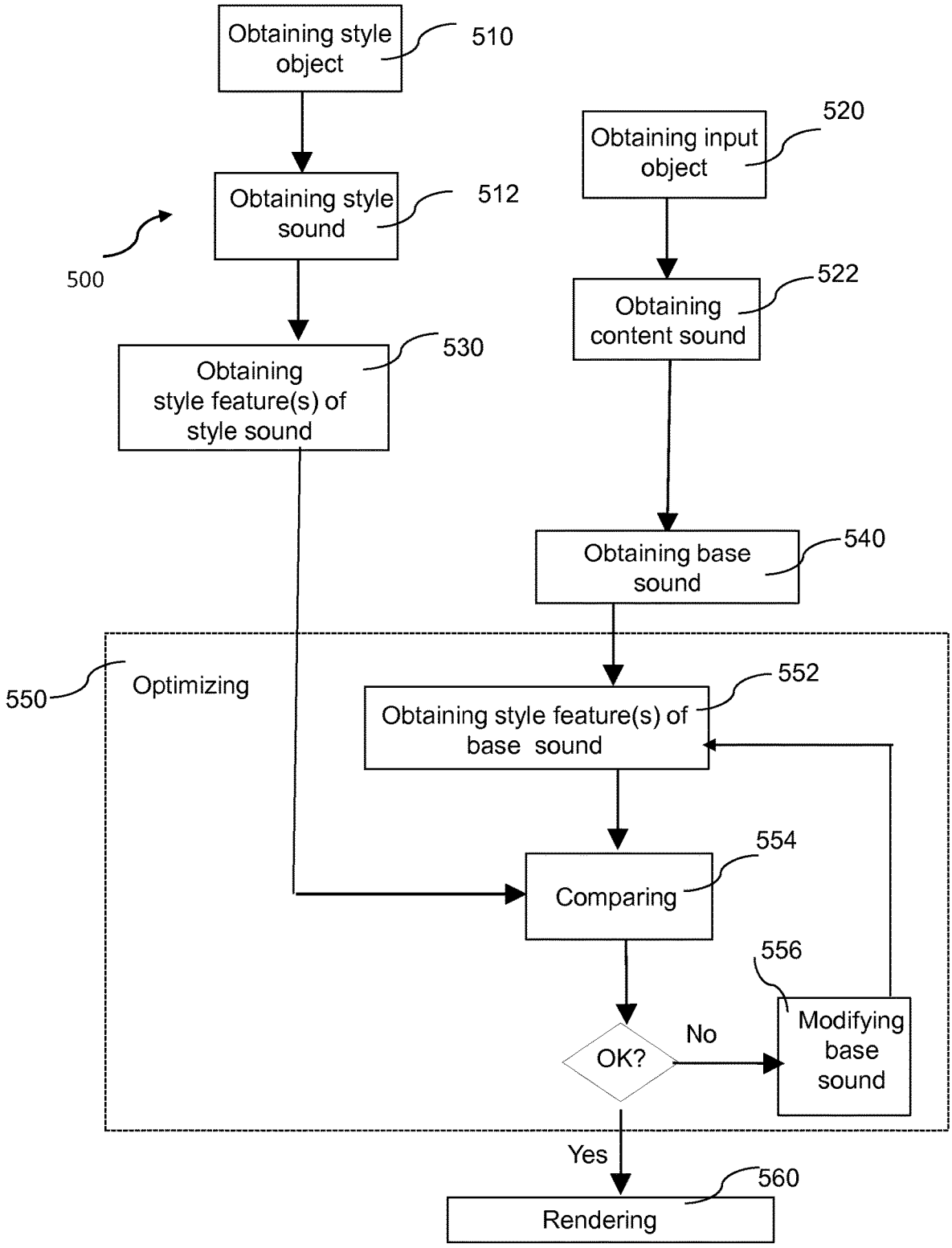
FIG. 5A is a functional diagram that illustrates a first examplary embodiment of the method of the present disclosure.

FIG. 5A describes a first exemplary embodiment of the method of the present disclosure. In the exemplary embodiment described, the method can be an unsupervised method, which does not require a training phase.

In the exemplary embodiment illustrated by FIG. 5A, the method 500 can comprise obtaining 520 an input audio object and obtaining 510 a reference audio object.

The obtaining can notably be performed at least partially by interacting with a user for instance (thanks to a user interface of the electronic device 60 of FIG. 6 for instance) or by interacting with a storage unit or a communication unit (like the storage unit and/or the communication unit of the electronic device 60 of FIG. 6).

In the exemplary embodiment illustrated by FIG. 5A, the method 500 can comprise obtaining 520 an input audio object and obtaining 510 a reference audio object. The method can also comprise obtaining 522 an audio component from the input audio object and obtaining 512 an audio component from the reference audio object. Depending on the nature of the input and/or reference audio object, the obtaining of an input and/or reference audio object, and the obtaining of the corresponding audio component can be a single step.

The audio component of the input audio object can be for instance a guitar piece, and the audio component of the reference (or example) audio object (defining the change to be made on the input object) can be for instance a piano piece.

Referring to the above naming convention, the audio component of the input audio object is referred to herein after as "content sound" and the audio component of the reference audio object is called herein after "style sound".

As illustrated by FIG. 5A, the method can comprise obtaining 530 at least one style feature (or style characteristic). In the exemplary embodiment illustrated by FIG. 5A, the at least one style feature can be representative of the style sound. Notably, the at least one style feature can for instance by extracted, as shown by FIG. 1, from the style sound by an audio style feature extractor component (or block) 1000. The way such an audio style feature extractor component is implemented can vary depending upon embodiments. Notably, in some embodiments, the audio style feature extractor component can be implemented by using some audio processing techniques, for instance audio synthesis technics. For instance, in the illustrated embodiment, the audio style feature extractor component can be implemented by using audio processing technics, that extract features like statistics (i.e. mean, variance, higher order statistics, etc) computed from the subbands, the envelopes and/or the modulation bands. Examples of such audio processing technics can include audio processing technics based at least partially on a biologically—motivated audio processing system (like the system illustrated in an exemplary purpose by FIG. 3) as disclosed by Josh H. McDermott and all in document "Sound texture perception via statistics of the auditory periphery: Evidence from sound synthesis," Neuron, vol. 71, no. 5, pp. 926-940, 2011.

Figure 3:
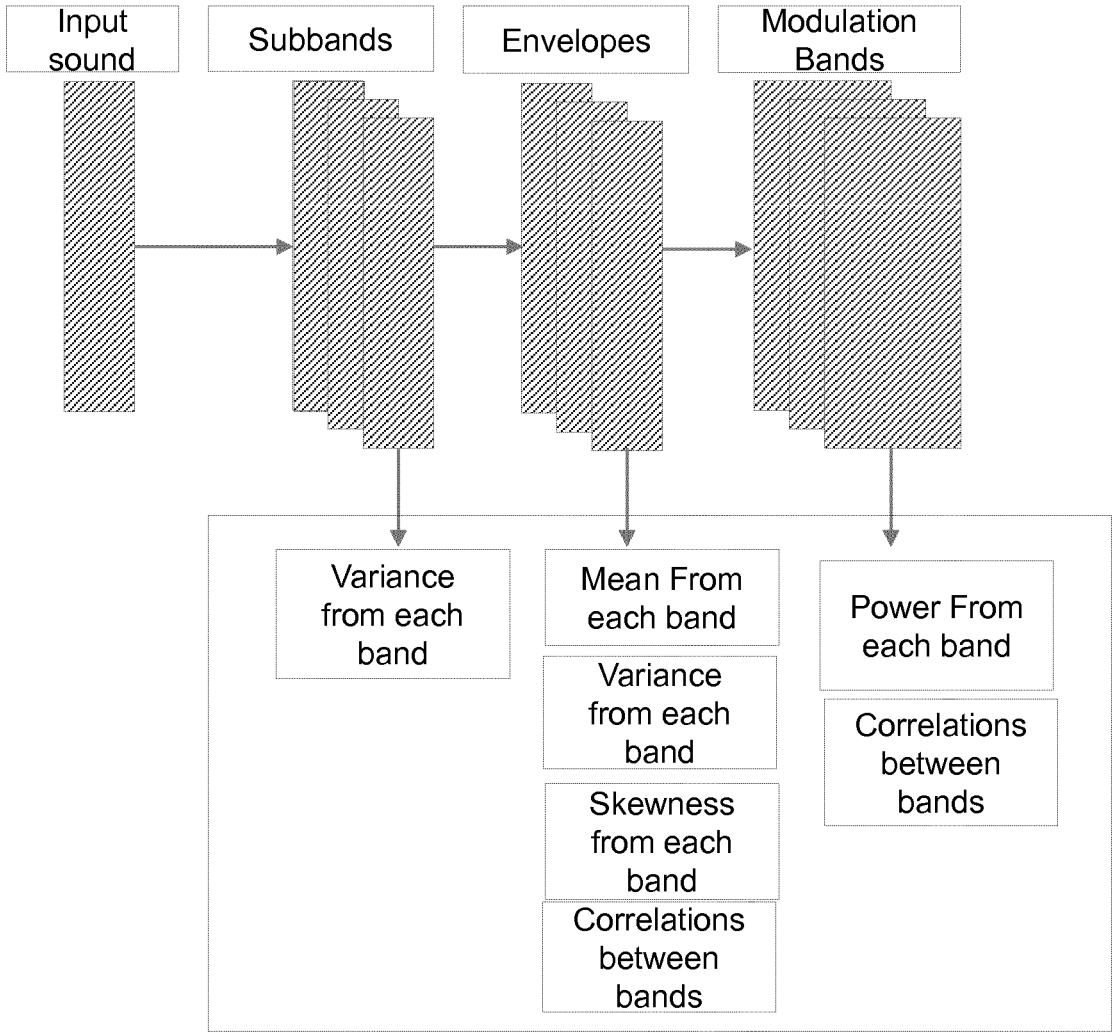
FIG. 3 shows an example of an auditory model that can be used according to at least one embodiment of the present disclosure for obtaining biologically-motivated audio features.

According to FIG. 3, an Input audio signal (wether content sound or style sound) is first modulated by K subband filters (e.g. K=10, K=20, K=30, K=40 or K=50) in a first layer (layer 1). A second Layer (layer 2) computes the envelopes of these subband signals for other statistics. Further modulation is done at an upper layer (e.g. layer 3). All the statistics from these three layers can be used for the style loss (introduced hereinafter) for instance.

In other embodiments, the audio style feature extractor component can be implemented by using a Deep Neural Network (DNN) trained for an audio classification task.

Figure 4:
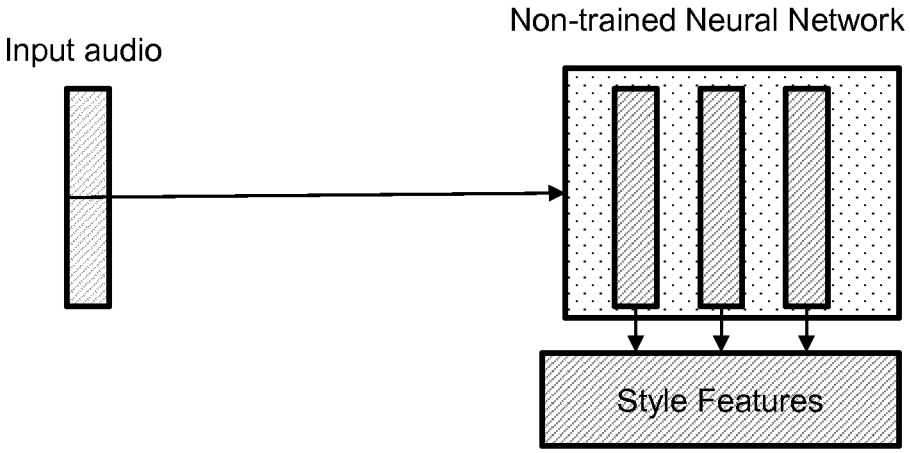
FIG. 4 shows an example of a neural network that can be used according to at least one embodiment of the present disclosure for obtaining audio features.

In still other embodiments, the audio style feature extractor component can be implemented by using a non-trained neural network (as illustrated in an exemplary purpose by FIG. 4). FIG. 4 shows an example of a neural network being for instance a Non-trained Neural Network, or a random neural network, that can be used according to at least one embodiment of the present disclosure for obtaining audio features. In such an embodiment, the weights of the neural network can be randomly defined.

The obtaining 510 of a style object and/or the obtaining 520 of a style sound can be optional. Indeed, in some embodiments, the style feature can be read from a storage medium, or received from a communication interface. For instance, the same style features can be used successively for processing several content sound. Notably, the style feature can have been previously obtained (or determined) according to a reference style audio object and/or a reference style sound.

In some embodiments, the style feature can be obtained from a reference style sound read from a storage medium or received from a communication interface, after having been previously extracted from a reference style audio object.

In the exemplary embodiment illustrated by FIG. 5A, the method can comprise generating the desired, "styled" sound by optimizing 550 a base sound. Depending upon embodiments, the way the base sound is obtained can differ. Notably, according to FIG. 5A, the method can comprise obtaining 540 the base signal by copying the content sound.

In the exemplary embodiment described, the optimizing can also comprise obtaining 552 at least one style feature (of characteristic) from the base sound. The at least one style features can for instance by extracted, as shown by FIG. 1, from the base sound by an audio style feature extractor component (or block) 2000. As for the style feature extractor used for obtaining the style feature of the style sound, the style feature extractor used for obtaining the style feature of the base sound can vary depending upon embodiments. The exemplary embodiments cited in link with the style feature extractor component 1000 used for the style sound can also apply to the audio style feature extractor component 2000 for the base sound.

Notably, in some embodiments, the style features of the base sound and the style sound can be obtained by a single style feature extractor component.

In other embodiments, they can be obtained by two different or identical (or almost identical) style feature extractor. Notably, in at least some embodiments, at least some of the style features extracted from the base sound can relate to same type of features than at least one of the style features extracted from the content sound. For instance, a feature based on a same statistic can be used for both sounds.

In the exemplary embodiment illustrated by FIG. 5A, the method can comprise comparing 554 at least one of the style features of the style sound with at least one corresponding feature of the style features of the base sound. The comparing can notably comprise, as illustrated by FIG. 1, computing 3000 the style loss. For instance, the style loss can be computed by assessing a distance (e.g. Euclidian distance) between the statistics of the style features extracted from the content sound and those extracted from the style sound.

In the exemplary embodiment illustrated by FIG. 5A, the method can comprise modifying 556 the base signal by taking account of the result of the comparing 554. For instance, the modifying can be performed in a way that permit to decrease the style loss.

As illustrated by FIGS. 5A and 1, the optimizing '(550, 4000) can be performed iteratively. Indeed, in some embodiments, thanks to successive iterations, the optimizing can permit to gradually transform the base sound into an output sound having the style of the style sound. This iterating of the optimizing can be based for instance on a gradient descent method and can comprise minimizing a loss function. This loss function can be for instance the style loss resulting from the comparing 554 (and computed in block 3000 of FIG. 1).

Depending on the embodiments, different stopping criteria can be used for ending the iterating of the optimizing. For example, the optimizing can iterate until the loss function reaches a certain value, for instance until the loss function reaches a value lower than a first value, used as a threshold. Depending upon embodiments, this threshold first value can vary. For instance, the first value can be defined as an target absolute value for the loss function, or as a percentage of the initial value of the loss function. It some embodiment for instance, the first value can be a percentage of the initial value of the loss function in the range [0; 20] like, 2%, 5%, 10%, 15% of the initial value.

As illustrated by FIG. 5A, the method can comprise rendering 560 of at least a part of the reference, input and/or output visual object. Depending upon embodiments, and of the nature of the audio input and/or reference objects (and thus of the nature of the resulting output object), being either of audio type only and/or including a video component, the rendering can be diverse. It can notably comprise outputting an audio component of an audio object, on an audio output interface by a loudspeaker for instance. It can also include displaying at least partially a video component of an audio object on a display on the device where the method of the present disclosure is performed, and/or storing at least one of the above information on a specific support. This rendering is optional.

Figure 5B:
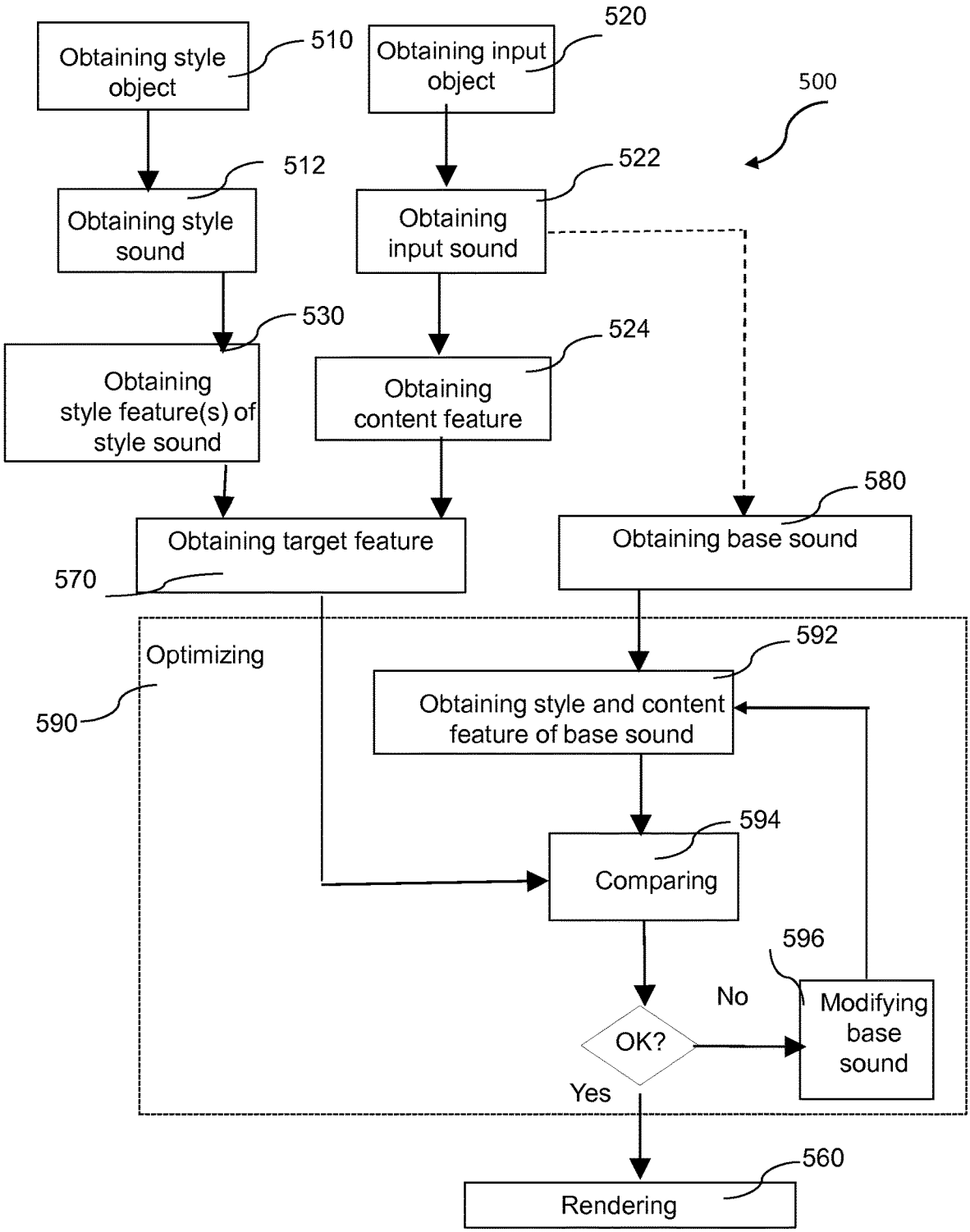
FIG. 5B is a functional diagram that illustrates a second examplary embodiment of the method of the present disclosure.

FIG. 5B describes a second exemplary embodiment of the method of the present disclosure. As illustrated by FIG. 5B, in the second exemplary embodiment, the method 500 can comprise obtaining 520 an input audio object, obtaining 510 a reference audio object and obtaining 522, 512 audio components from the input audio object and the reference audio object. In the embodiment of FIG. 5B, the method can also comprise obtaining 530 at least one style feature (of characteristic) from the style sound. Those steps 510, 512, 520, 522 and 520 can be performed similarly to what have already been described above in link with FIG. 5A. Notably, the obtaining of a style object and the obtaining of a style sound can be optional.

In the exemplary embodiment illustrated by FIG. 5B, the method can further comprise obtaining 524 at least one content feature (of characteristic) from the content sound. The at least one content features can for instance by extracted, from the content sound by an audio content feature extractor component. As for the style feature extractor used for obtaining the style feature of the style sound, the content feature extractor used for obtaining the content feature of the content sound can vary depending upon embodiments.

Notably, in some embodiments, the style features of the style sound and the content features of the content sound can be obtained by a single feature extractor component, adapted to output different kind of features (for instance by using output of different layers issued of a same conceptual model for instance). In other embodiments, the style features of the style sound and the content features of the content sound can be obtained by two similar feature extractor components, adapted to output the same kind of features (including style and content features). In still other embodiments, the style features of the style sound and the content features of the content sound can be obtained by two different feature extractor components, outputting different kind of features (like style or content features). For instance, in the illustrated embodiment, both feature extractor component can be implemented by using a single feature extractor using for instance audio processing technics based at least partially on a biologically-motivated audio processing system as the one illustrated in an exemplary purpose by FIG. 3).

In still other embodiments, the style feature extractor and the content feature extractor component can be implemented by using different technics.

According to FIG. 5B, the method can comprise obtaining 570 a target feature set from the obtained style features and the obtained content feature.

The method can also comprise generating the desired, "styled" sound by optimizing 590 a base sound. The optimizing 590 can comprise obtaining 580 a base sound by copying the content sound, as in the embodiment illustrated by FIG. 5A, or a random signal, or a signal with a given pattern of digital values, like with only "0" values, or with only "1" values. The optimizing can comprise obtaining 592 style and content features relating to the base signal, at least one of the style and content features being as a same type as at least one of the target features. In the exemplary embodiment described, the optimizing can then be performed similarly to what have been described in link with FIG. 5A except that the optimizing 590 can comprise a comparing 594 performed between the target features and the style and content features obtained from the base signal. The optimizing 590 can comprise a modifying 596 that can be performed similarly to what have been described in link the modifying 556 illustrated by FIG. 5A.

According to FIG. 5B, the method can also comprise rendering 560 of at least a part of the reference, input and/or output visual object. The rendering can be performed similarly to the rendering already described in link with FIG. 5A. Notably, as for the embodiment illustrated by FIG. 5A, the rendering is optional.

In some embodiment, the output audio object can include a video component. Depending upon embodiments, this video component can be a copy or and altered version of a video component of the input audio object or the reference audio object, or can be obtained from a video content external to the input audio object and to the reference audio object.

As an exemplar, the input audio object can be a human voice, the reference audio object can comprise a video of a wave and the corresponding wave sound and the output audio object can comprise the human voice with a "wave" style, timely synchronized with the video of the wave extracted from the reference audio object.

The above embodiments have been mainly described in link with a single input sound and a single style sound. However, some embodiments of the present disclosure can be applied to several input sounds and/or several style sounds. For instance, a styled (or output) content can be generated based on several different input sounds, issued from instance from several distinct audio objects, or from a single one, by using style features obtained from several different style sounds, issued from instance from several distinct audio objects, or from a single one. For instance, such embodiment can be applied to give a unified "audio look" to audio components of a TV series by using the same style features for processing the audio components.

The above embodiments have been described in link with at least one style feature representative of at least one audio signal. In a variant, the style feature can be at least partially representative of a signal other than an audio signal, like a video signal comprising at least one image. Optionally, the obtaining of the at least one reference style feature (that will be a target for the style transfer) can comprise transforming at least one reference style feature of the signal other than an audio signal.

As will be appreciated by one skilled in the art, aspects of the present principles can be embodied as a system, method, or computer readable medium. Accordingly, aspects of the present disclosure can take the form of a hardware embodiment, a software embodiment (including firmware, resident software, micro-code, and so forth), or an embodiment combining software and hardware aspects that can all generally be referred to herein as a "circuit", module" or "system". Furthermore, aspects of the present principles can take the form of a computer readable storage medium. Any combination of one or more computer readable storage medium(s) may be utilized.

A computer readable storage medium can take the form of a computer readable program product embodied in one or more computer readable medium(s) and having computer readable program code embodied thereon that is executable by a computer. A computer readable storage medium as used herein is considered a non-transitory storage medium given the inherent capability to store the information therein as well as the inherent capability to provide retrieval of the information therefrom. A computer readable storage medium can be, for example, but is not limited to, an electronic, magnetic, optical, electromagnetic, infrared, or semiconductor system, apparatus, or device, or any suitable combination of the foregoing.

It is to be appreciated that the following, while providing more specific examples of computer readable storage mediums to which the present principles can be applied, is merely an illustrative and not exhaustive listing as is readily appreciated by one of ordinary skill in the art: a portable computer diskette, a hard disk, a read-only memory (ROM), an erasable programmable read-only memory (EEPROM or Flash memory), a portable compact disc read-only memory (CD-ROM), an optical storage device, a magnetic storage device, or any suitable combination of the foregoing.

Thus, for example, it will be appreciated by those skilled in the art that the block diagrams presented herein represent conceptual views of illustrative system components and/or circuitry of some embodiments of the present principles. Similarly, it will be appreciated that any flow charts, flow diagrams, state transition diagrams, pseudo code, and the like represent various processes which may be substantially represented in computer readable storage media and so executed by a computer or processor, whether or not such computer or processor is explicitly shown.

Although the illustrative embodiments have been described herein with reference to the accompanying drawings, it is to be understood that the present principles are not limited to those precise embodiments, and that various changes and modifications may be effected therein by one of ordinary skill in the pertinent art without departing from the scope of the present principles. All such changes and modifications are intended to be included within the scope of the present principles as set forth in the appended claims.

The present principles notably propose a method for processing at least one input audio signal.

According to at least one embodiment of the present disclosure, the method comprises:

generating at least one output audio signal from the at least one input audio signal by optimizing at least one base signal by taking account of at least one reference style feature.

According to at least one embodiment of the present disclosure, the at least one reference style feature is representative of a style of at least one reference audio signal.

According to at least one embodiment of the present disclosure, the optimizing can be performed iteratively.

According to at least one embodiment of the present disclosure, the optimizing comprises obtaining at least one base style feature representative of a style of the base signal and modifying the base signal by taking into account the reference style feature and the base style feature.

According to at least one embodiment of the present disclosure, the method comprises obtaining at least one input content feature representative of a content of the input signal.

According to at least one embodiment of the present disclosure, the optimizing comprise obtaining at least one base content feature representative of a content of the base signal and modifying the base signal by taking into account the input content feature and base content feature.

According to at least one embodiment of the present disclosure, obtaining at least one of the reference style feature, the input content feature, the base style feature and the base content feature comprises processing at least one of the input audio signal, the reference audio signal and the base audio signal in a neural network.

According to at least one embodiment of the present disclosure, obtaining at least one of the reference style feature, the input content feature, the base style feature and the base content feature comprises processing at least one of the input audio signal, the reference audio signal and the base audio signal in a Biologically-motivated audio processing system.

According to at least one embodiment of the present disclosure, the method comprises:

obtaining at least one base audio signal being a copy of the at least one input audio signal;

generating at least one output audio signal from the at least one base audio signal, the at least one output audio signal having style features obtained by modifying the at least one base signal so that a distance between at least one base style feature representative of a style of the at least one base signal and at least one reference style feature decreases.

According to at least one embodiment of the present disclosure, the at least one reference style feature is representative of a style of at least one reference audio signal.

According to at least one embodiment of the present disclosure, modifying the at least one base signal takes into account a distance between at least one input content feature representative of a content of the at least one input signal and at least one base content feature representative of a content of the at least one base signal According to at least one embodiment of the present disclosure, at least one of the at least one reference style feature, the at least one input content feature, the at least one base style feature and the at least one base content feature is obtained by processing at least one of the input audio signal, the at least one reference audio signal and/or the at least one base audio signal in at least one neural network.

According to at least one embodiment of the present disclosure, obtaining the at least one reference style feature comprises at least one of:

subband filtering of the at least one reference audio signal;

obtaining an envelope of the at least one subband filtered reference audio signal;

modulating the obtained envelope.

According to at least one embodiment of the present disclosure, obtaining the at least one base style feature comprises at least one of:

subband filtering of the at least one base signal;

obtaining an envelope of the at least one subband filtered base signal;

modulating the obtained envelope.

According to another aspect, the present disclosure relates to an electronic device comprising at least one memory and one or several processors configured for collectively processing at least one input audio signal.

According to at least one embodiment of the present disclosure, the processing comprises:

generating at least one output audio signal from the at least one input audio signal by optimizing at least one base signal by taking account of at least one reference style feature.

According to at least one embodiment of the present disclosure, the input audio signal, the reference audio signal and/or the base audio signal comprises a speech content.

According to at least one embodiment of the present disclosure, the input audio signal, the reference audio signal and/or the base audio signal comprises an audio content other than a speech content.

According to at least one embodiment of the present disclosure, the base audio signal obtained from a random digital pattern and/or a repetitive digital pattern.

According to at least one embodiment of the present disclosure, the base audio signal is obtained from the input audio signal.

According to at least one embodiment of the present disclosure, the base audio signal is a copy of the input audio signal.

According to at least one embodiment of the present disclosure, the processing comprises:

obtaining at least one base audio signal being a copy of the at least one input audio signal;

generating at least one output audio signal from the at least one base signal, the at least one output audio signal having style features obtained by modifying the at least one base signal so that a distance between at least one base style feature representative of a style of the at least one base signal and at least one reference style feature decreases.

According to at least one embodiment of the present disclosure, the at least one input audio signal, and/or the at least one reference audio signal comprises a speech content.

According to at least one embodiment of the present disclosure, the at least one input audio signal and/or the at least one reference audio signal comprises an audio content other than a speech content.

According to at least one embodiment of the present disclosure, the at least one reference style feature is representative of a style of at least one reference audio signal.

According to at least one embodiment of the present disclosure, modifying the at least one base signal takes into account a distance between at least one input content feature representative of a content of the at least one input signal and at least one base content feature representative of a content of the at least one base signal According to at least one embodiment of the present disclosure, at least one of the at least one reference style feature, the at least one input content feature, the at least one base style feature and the at least one base content feature is obtained by processing at least one of the at least one input audio signal, the at least one reference audio signal and/or the at least one base audio signal in at least one neural network.

According to at least one embodiment of the present disclosure, obtaining the at least one reference style feature comprises at least one of:

subband filtering of the at least one reference audio signal;

obtaining an envelope of the at least one subband filtered signal;

modulating the obtained envelope.

According to at least one embodiment of the present disclosure, obtaining the at least one base style feature comprises at least one of:

subband filtering of the at least one base signal;

obtaining an envelope of the at least one subband filtered base signal;

modulating the obtained envelope.

According to another aspect, the present disclosure relates to a non-transitory computer readable program product comprising program code instructions for performing the method of the present disclosure, in any of its embodiments, when the software program is executed by a computer.

According to at least one embodiment of the present disclosure, the non-transitory computer readable program product comprises program code instructions for performing, when the non-transitory software program is executed by a computer, a method for processing at least one input audio signal, the method comprising generating at least one output audio signal from the at least one input audio signal by optimizing at least one base signal by taking account of at least one reference style feature.

According to at least one embodiment of the present disclosure, the non-transitory computer readable program product comprises program code instructions for performing, when the non-transitory software program is executed by a computer, a method for processing at least one input audio signal, the method comprising:

obtaining at least one base audio signal being a copy of the at least one input audio signal;

generating at least one output audio signal from the at least one base signal, the at least one output audio signal having style features obtained by modifying the at least one base signal so that a distance between at least one base style feature representative of a style of the at least one base signal and at least one reference style feature decreases.

According to another aspect, the present disclosure relates to a non-transitory program storage device, readable by a computer.

According to at least one embodiment of the present disclosure, the present disclosure relates to a non-transitory program storage device carrying a software program comprising program code instructions for performing the method of the present disclosure, in any of its embodiments, when the software program is executed by a computer.

Notably, according to at least one embodiment of the present disclosure, the software program comprises program code instructions for performing, when the non-transitory software program is executed by a computer, a method for processing at least one input audio signal, the method comprising:

generating at least one output audio signal from the at least one input audio signal by optimizing at least one base signal by taking account of at least one reference style feature.

According to at least one embodiment of the present disclosure, the software program comprises program code instructions for performing, when the non-transitory software program is executed by a computer, a method for processing at least one input audio signal, the method comprising:

obtaining at least one base audio signal being a copy of the at least one input audio signal;

generating at least one output audio signal from the at least one base signal, the at least one output audio signal having style features obtained by modifying the at least one base signal so that a distance between at least one base style feature representative of a style of the at least one base signal and at least one reference style feature decreases.

According to another aspect, the present disclosure relates to a computer readable storage medium carrying a software program.

According to at least one embodiment of the present disclosure, the software program comprises program code instructions for performing the method of the present disclosure, in any of its embodiments, when the software program is executed by a computer.

Notably, according to at least one embodiment of the present disclosure, the software program comprises program code instructions for performing, when the non-transitory software program is executed by a computer, a method for processing at least one input audio signal, the method comprising:

generating at least one output audio signal from the at least one input audio signal by optimizing at least one base signal by taking account of at least one reference style feature.

According to at least one embodiment of the present disclosure, the software program comprises program code instructions for performing, when the non-transitory software program is executed by a computer, a method for processing at least one input audio signal, the method comprising:

obtaining at least one base audio signal being a copy of the at least one input audio signal;

generating at least one output audio signal from the at least one base signal, the at least one output audio signal having style features obtained by modifying the at least one base signal so that a distance between at least one base style feature representative of a style of the at least one base signal and at least one reference style feature decreases.

The invention claimed is:

1. An electronic device comprising at least one memory and one or several processors configured for:

obtaining at least one base audio signal; and generating at least one output audio signal from said at least one base audio signal by iteratively modifying a same temporal portion of said at least one base audio signal to gradually transform said same temporal portion of said at least one base audio signal into a corresponding temporal portion of said at least one output audio signal such that a distance between at least one base style feature representative of a base style of said at least one base audio signal and at least one reference style feature representative of a reference style decreases, wherein said same temporal portion of said at least one base audio signal is iteratively modified until said distance reaches a value and wherein said at least one base audio signal comprises an audio content other than a speech content, the audio content being iteratively modified according to the reference style to be included in the at least one output audio signal.

2. The electronic device according to claim 1, wherein said at least one base audio signal comprises a speech content.

3. The electronic device according to claim 1, wherein said reference style is a style of at least one reference audio signal.

4. The electronic device according to claim 3 wherein said at least one reference audio signal comprises a speech content.

5. The electronic device according to claim 3, wherein said at least one reference audio signal comprises an audio content other than a speech content.

6. The electronic device according to claim 3, wherein at least one of said at least one reference style feature and said at least one base style feature is obtained by processing at least one of said at least one reference audio signal and said at least one base audio signal in at least one neural network.

7. The electronic device according to claim 3, wherein obtaining said at least one reference style feature comprises at least one of:

subband filtering of said at least one reference audio signal;

obtaining an envelope of said at least one filtered reference audio signal; and modulating said obtained envelope.

8. The electronic device according to claim 1, wherein obtaining said at least one base style feature comprises at least one of:

subband filtering of said at least one base audio signal;

obtaining an envelope of said at least one filtered base audio signal; and modulating said obtained envelope.

9. A method comprising:

obtaining at least one base audio signal; and generating at least one output audio signal from said at least one base audio signal by iteratively modifying a same temporal portion of said at least one base audio signal to gradually transform said same temporal portion of said at least one base audio signal into a corresponding temporal portion of said at least one output audio signal such that a distance between at least one base style feature representative of a base style of said at least one base audio signal and at least one reference style feature representative of a reference style decreases, wherein said same temporal portion of said at least one base audio signal is iteratively modified until said distance reaches a value and wherein said at least one base audio signal comprises an audio content other than a speech content, the audio content being iteratively modified according to the reference style to be included in the at least one output audio signal.

10. The method according to claim 9, wherein said reference style is a style of at least one reference audio signal.

11. The method according to claim 10, wherein said at least one reference audio signal comprises a speech content.

12. The method according to claim 10, wherein said at least one reference audio signal comprises an audio content other than a speech content.

13. The method according to claim 10, wherein at least one of said at least one reference style feature and said at least one base style feature is obtained by processing at least one of said at least one reference audio signal and said at least one base audio signal in at least one neural network.

14. The method according to claim 10, wherein obtaining said at least one reference style feature comprises at least one of:

subband filtering of said at least one reference audio signal;

obtaining an envelope of said at least one filtered reference audio signal; and modulating said obtained envelope.

15. The method according to claim 9, wherein obtaining said at least one base style feature comprises at least one of:

subband filtering of said at least one base audio signal;

obtaining an envelope of said at least one filtered base audio signal; and modulating said obtained envelope.

16. A non-transitory computer readable storage medium, comprising program code instructions executable by a processor, for:

obtaining at least one base audio signal; and generating at least one output audio signal from said at least one base audio signal by iteratively modifying a same temporal portion of said at least one base audio signal to gradually transform said same temporal portion of said at least one base audio signal into a corresponding temporal portion of said at least one output audio signal such that a distance between at least one base style feature representative of a base style of said at least one base audio signal and at least one reference style feature representative of a reference style decreases, wherein said same temporal portion of said at least one base audio signal is iteratively modified until said distance reaches a value and wherein said at least one base audio signal comprises an audio content other than a speech content, the audio content being iteratively modified according to the reference style to be included in the at least one output audio signal.

* * * * *